US005253372A

United States Patent [19]

Boker

[11] Patent Number: 5,253,372

[45] Date of Patent: Oct. 19, 1993

[54] APPARATUS FOR DISPENSING MEASURED LENGTHS OF TUBULAR FILMS ONTO AN ARMATURE

[75] Inventor: Samuel J. Boker, Ridge, N.Y.

[73] Assignee: Sani-Tech Industries, Inc., Hicksville, N.Y.

[21] Appl. No.: 834,642

[22] Filed: Feb. 12, 1992

[51] Int. Cl.[5] ..... A47K 13/14

[52] U.S. Cl. ..... 4/243.2; 4/244.2

[58] Field of Search ..... 4/243.2, 244.2, 245.2, 4/245.7; 242/55.2

[56] References Cited

U.S. PATENT DOCUMENTS

| | | | |
|---|---|---|---|
| 1,589,429 | 6/1926 | Rouse . | |
| 2,243,134 | 5/1941 | Stiller | 4/243.3 |
| 3,913,519 | 10/1975 | Sugano . | |
| 4,213,212 | 7/1980 | Hefty et al. | 4/243 |
| 4,236,449 | 12/1980 | Price | 101/228 |
| 4,272,688 | 6/1981 | Cook et al. | 307/123 |
| 4,532,500 | 7/1985 | Henk | 340/675 |
| 4,566,648 | 1/1985 | Hefty et al. | 242/67.3 R |
| 4,581,514 | 4/1986 | Inoue | 219/69 M |
| 4,662,009 | 5/1987 | Hefty | 4/243.2 |
| 4,766,618 | 8/1988 | Boker | 4/243.2 |
| 4,910,809 | 3/1990 | Boker | 4/243.2 X |

FOREIGN PATENT DOCUMENTS

| | | | |
|---|---|---|---|
| 0292946 | 11/1988 | European Pat. Off. | 4/243.2 |
| 87682 | 10/1936 | Sweden . | |

OTHER PUBLICATIONS

Sani Seat Brochure 10800/Sas-Buyline 4271 of Sani--Tech Industries Inc., Hicksville, NY.

*Primary Examiner*—William A. Cuchlinski, Jr.
*Assistant Examiner*—W. Morris Worth
*Attorney, Agent, or Firm*—Schweitzer Corman & Gross

[57] ABSTRACT

An apparatus for dispensing measured lengths of a sleeve material upon an armature, especially adapted for dispensing a plastic cover upon a toilet seat, includes a source of sleeve material fed onto the armature and collected upon a take-up reel. The cover is provided with a uniform series of marks along its length which are sensed and counted to control the operation of a motor drive which directs the sleeve material to and from the armature. Timer circuits are employed to cause motor cut-off if the required length of sleeve is not dispensed within a given length of time and to inhibit motor start for a fixed period after a dispensation. The sleeve-accepting end of the armature may include an angular horn to permit the sleeve to smoothly pass onto the seat.

18 Claims, 5 Drawing Sheets

APPARATUS FOR DISPENSING MEASURED LENGTHS OF TUBULAR FILMS ONTO AN ARMATURE

The present invention relates to an apparatus for covering an armature, such as a toilet seat, with a measured length of a flexible sleeve.

BACKGROUND OF THE INVENTION

The prior art, exemplified by U.S. Pat. No. 4,766,618 of Aug. 30, 1988 to the present inventor, discloses mechanisms by which a toilet seat or similar armature-like structure may be covered by a flexible sleeve or cover, such as to improve the sanitary condition thereof. In particular, the prior art discloses a variety of mechanisms for loading a length of protective sleeve on a toilet seat from a first source and then collecting the used section of sleeve in a collection box or mandrel, while simultaneously dispensing a new length of sleeve onto the seat. Such lengths are typically continuous elements of an extended length roll of the sleeve material.

Such prior art, however, suffers from deficiencies in accurately monitoring the length of sleeve to be dispensed. Such mechanisms also often twist the sleeve, which subjects the mechanism to jamming.

In addition, the prior art provides little protection against misuse of the apparatus. For example, it is often possible to cause subsequent lengths of sleeve to be dispensed without intervening usage, thus leading to product waste. In addition, devices of the prior art fail to include appropriate safeguards to prevent operation of the drive mechanisms in the event of jamming, loss of sleeve material and the like. Without proper protection automated advance mechanisms may operate continuously.

It is accordingly a purpose of the present invention to provide a new and improved mechanism for the dispensation of a tube-like sleeve material along an armature, such as a toilet seat, in a manner which provides for precise control over the length of sleeve dispensed.

Yet another purpose of the present invention is to provide such an apparatus having improved safeguards against malfunctions and improper operation.

Still another purpose of the present invention is to provide such an apparatus which substantially eliminates jamming, and which provides for a smooth feed of the sleeve material onto the seat.

BRIEF DESCRIPTION OF THE INVENTION

In accordance with the above and other purposes and objects, the present invention utilizes an extended length of a tubular sleeving material supplied on a source or dispenser located at one end of the toilet bowl seat or other armature sought to be covered, and a collector or take-up means for the used lengths of the tubing at a second end. Drive means are operatively connected to the source and take-up means to permit a controlled length of tubing to be withdrawn from the source and positioned along and about the length of the armature. At the same time, the previous length located on the armature is collected by the take-up means.

In order to accurately and precisely meter the dispensing of the sleeving, a series of markings are provided along the length of the sleeve material. Such markings are sensed by a fixed sensor, which generates a pulse-like output upon passage of a mark, which output, is operatively connected to a drive controller. The controller, in response to a start signal, typically manually initiated, commences operation of the drive means, such operation continuing until a predetermined length of sleeve has been dispensed. The determination of this length occurs by the counting of the pulses produced by the sensor as the marking means pass thereby and comparing the total to a reference value. In a preferred embodiment of the invention the marks are spaced along the length of the sleeving a distance equal to the length of the armature or seat, whereby the receipt of a single pulse by the controller signifies that an armature-length of sleeve has been dispensed. The drive means are then disengaged to await the next start signal.

To prevent undesired operation, the present invention may include a first timer which halts operation of the drive means after a set period after receipt of the start signal by the controller in the event that the predetermined length of sleeve is not dispensed within that period. This provides protection against continued operation of the drive means in the event of jamming or other loss of sleeve. A second timer may be provided to disable the drive means for a fixed interval after dispensation of a new length of sleeve. This prevents a new start signal produced during that period of time from activating the drive mechanism.

The sleeve-receiving end of the seat or armature may be provided with a curved, tapered horn which facilitates spreading of the sleeve material from its supplied flat and compressed state and which substantially prevents twisting and knotting of the material as it passes onto the armature. This allows the sleeve to freely embrace the armature and to smoothly travel along its length.

BRIEF DESCRIPTION OF THE DRAWINGS

A fuller understanding of the present invention and the features and operation thereof will be made upon consideration of the following detailed description of a preferred, but nonetheless illustrative embodiment of the invention when considered in connection with the annexed drawings, wherein.

DETAILED DESCRIPTION OF THE INVENTION

Figure 1:
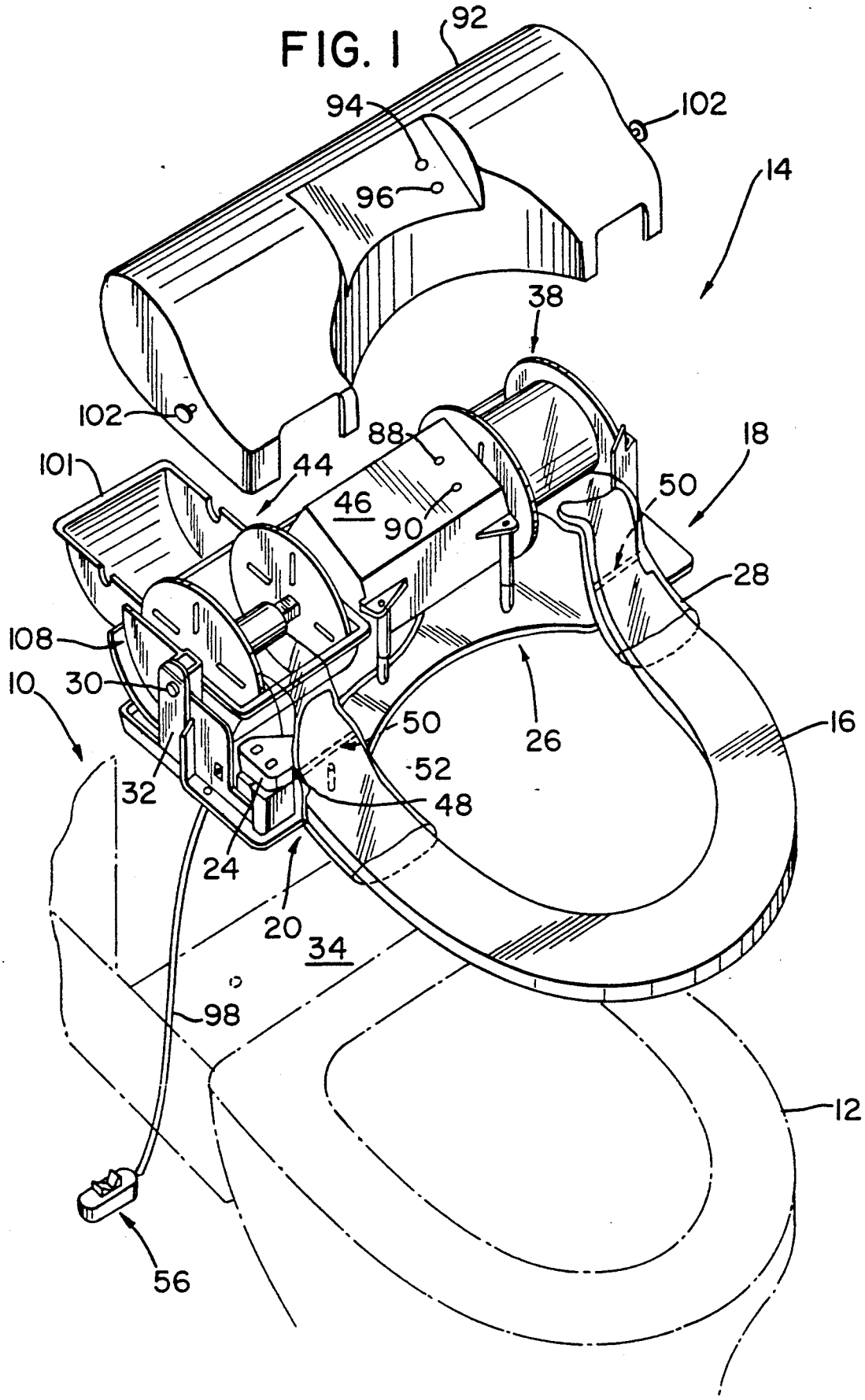
FIG. 1 is a perspective view of the invention in an exploded form showing the associated toilet apparatus in phantom.
Figure 2:
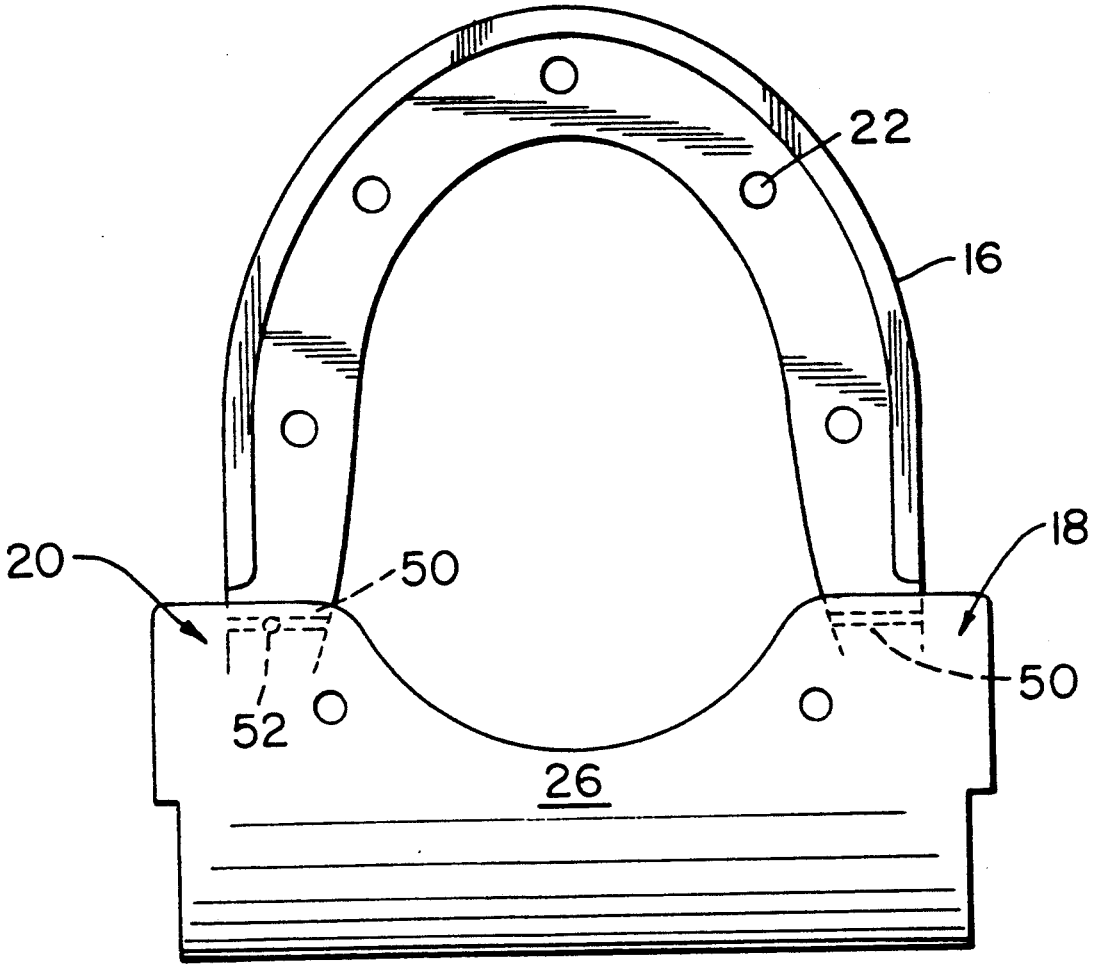
FIG. 2 is a bottom plan view of the seat of the present invention showing the markings applied to the tubular sleeving.

As seen in FIG. 1, a toilet 10 of conventional construction includes a bowl 12 with which the present invention 14 is associated. The invention comprises a seat 16, generally loop-shaped in plan, having a first end 18 and a second end 20. The seat sits upon the bowl 12 by virtue of a plurality of downward-extending projections or knobs 22, best seen in FIG. 2 projecting from the lower surface of the seat. The knobs limit the area of contact between the seat and bowl, and thus facilitate movement of the sleeve material around the seat.

The second end 20 of seat 16 is formed with a connecting arm 24, which affixes the seat to lower housing 26. The first end 18 of the seat is free from the housing to permit the sleeve material 28 to encase the seat. The combination of lower housing 26 and seat 16 are pivotally affixed by a pair of axles 30 extending through the opposed arms of a U-shaped mounting bracket 32 (FIGS. 3 and 4), the base 36 of which is mounted to the toilet, and typically to horizontal portion 34 behind bowl 12, seen in FIG. 1, by appropriate fasteners (not shown) extending through a pair of slots 104 which allow front-to-back adjustment of the seat assembly to the bowl. The entire seat assembly may be rotated about the axles upwardly away from the bowl for cleaning and the like. An upper housing 92 covers the lower housing and the components mounted thereon.

Tubular seat-embracing sleeve material 28, typically polyethylene or other plastic film, is provided as an extended length on a supply reel 38 mounted proximate the first end of the seat 16. Supply reel 38 is mounted for free rotation about axle 40, which is supported within lower housing 26 in a manner to allow the sleeve material to be fed onto the seat 16 with minimal resistance. The brackets which support the axle may be dimensioned and arranged in a known manner to allow insertion of a loaded reel and removal of an empty reel.

Figure 3:
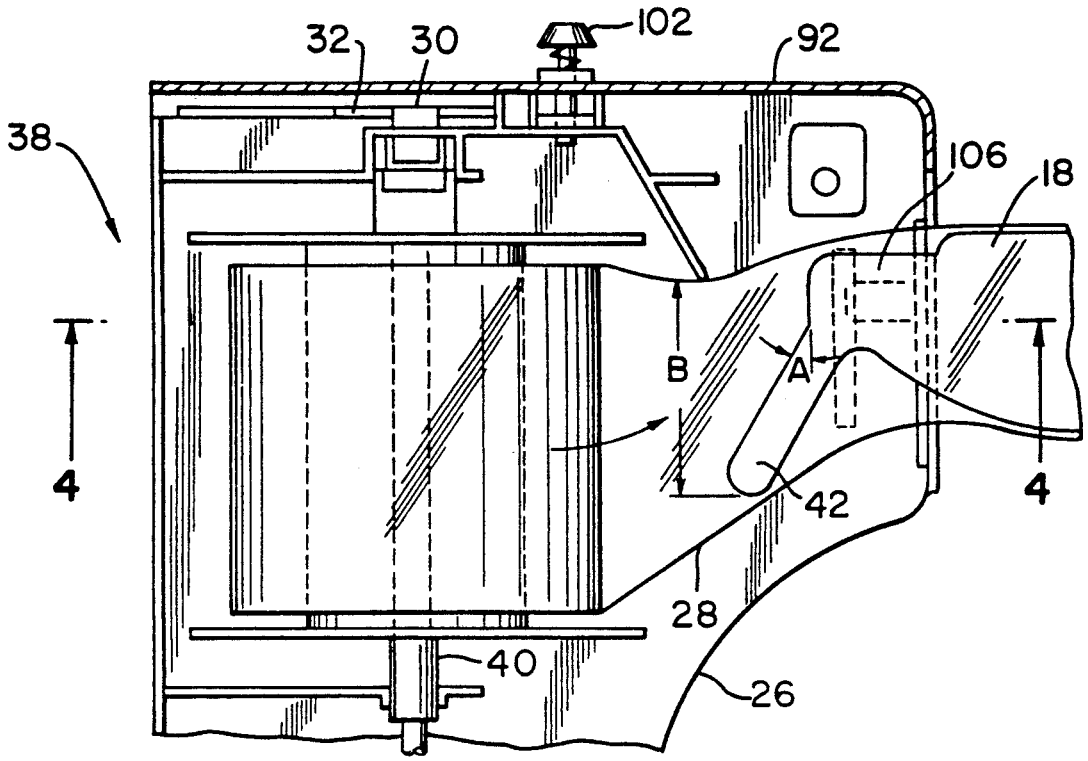
FIG. 3 is a plan view of the sleeve source and the first end of the seat or armature.
Figure 4:
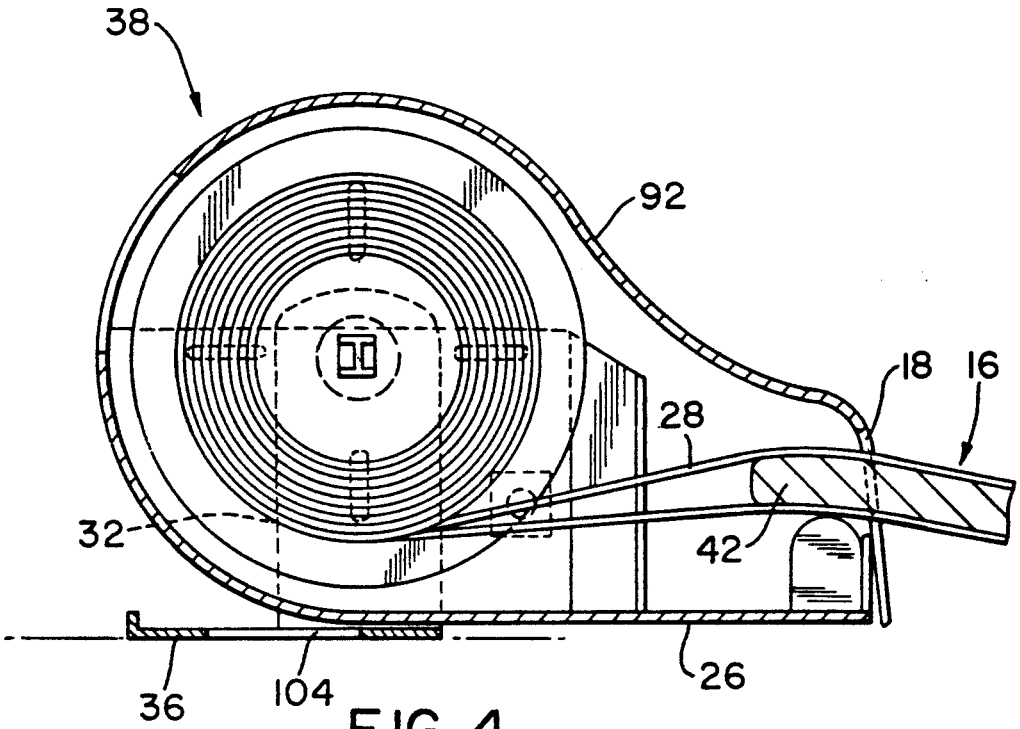
FIG. 4 is a section view taken along line 4—4 of FIG. 3.

Horn 42, best seen in FIG. 3 as extending from the seat first end 18, is adapted and dimensioned as guide means to spread the sleeve material from its flattened state as wound on supply reel 38 and to minimize bunching and twist of the sleeving as it leaves the supply reel. The horn 42 projects inwardly at an angle A of thirty degrees from the plane of the end of the seat and is provided with a rounded distal end to smoothly engage the dispenses sleeve. The first end of the seat is provided with a narrowed width shoulder portion 106 which, in conjunction with horn 42, describes a width B slightly greater than the width of the main portion of the seat. Thus, the sleeve is fully opened before it is fully inserted upon the seat.

Figure 5:
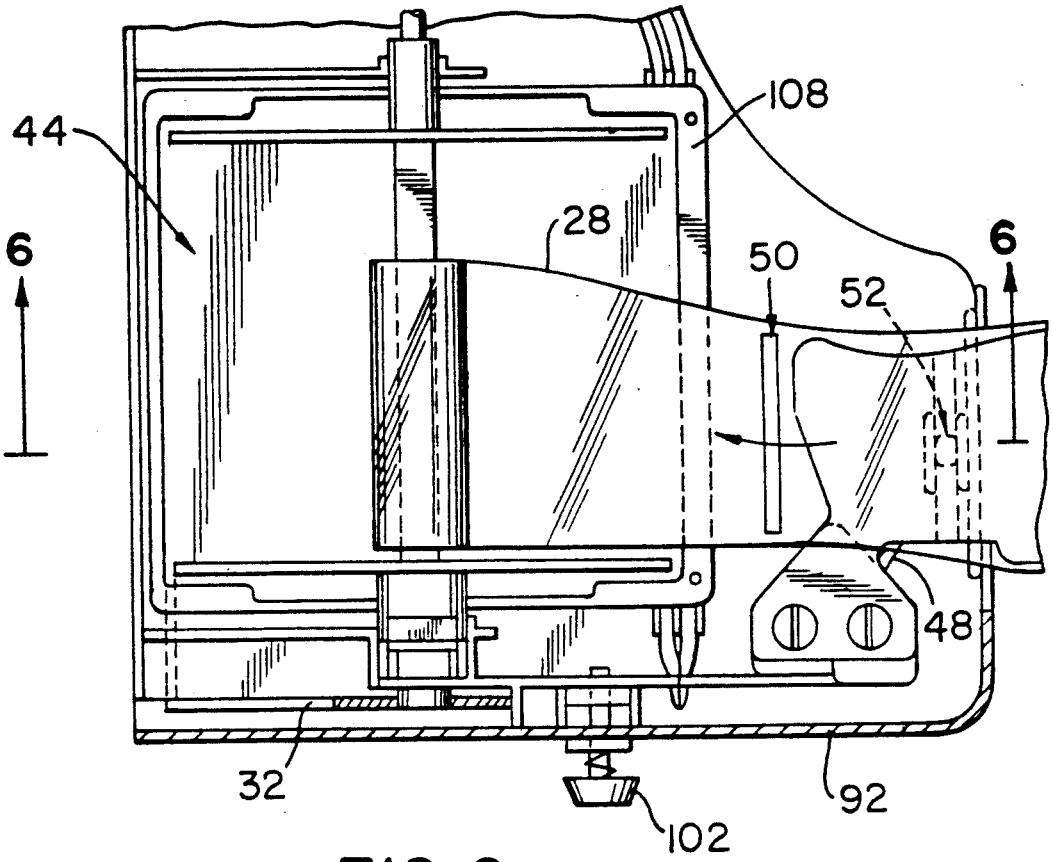
FIG. 5 is a top plan view of the sleeve take-up means and the area of the second end of the armature.
Figure 6:
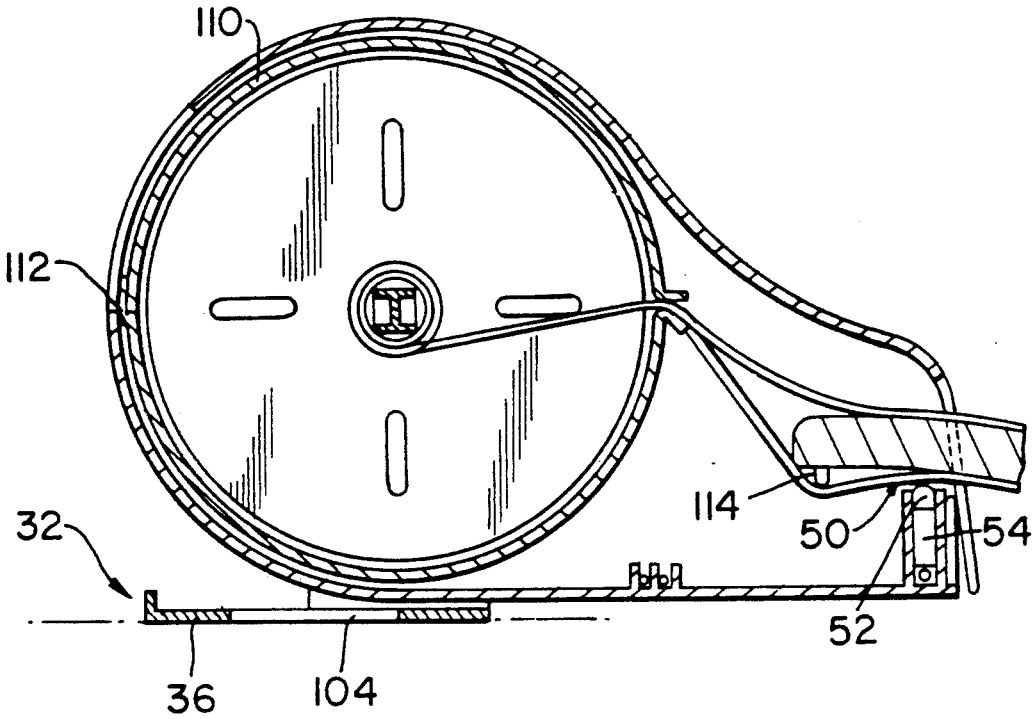
FIG. 6 is a cross-section view taken along line 6—6 of FIG. 5.

As further seen in FIGS. 5 and 6, take-up reel 44, which may be similar in construction to supply reel 28, is rotatably mounted on lower housing 26 proximate the second end 20 of the seat. As shown in FIGS. 1, 5 and 6, the take-up reel may be housed in a removable cassette unit 108 of a clamshell-like configuration, having a pivoting upper half 110 which allows access to the reel for engagement of the leading end of the sleeving 28 for take-up, and which may be closed to provide a convenient receptacle for the used sleeving and to prevent contact therewith. A similar cassette may be provided for supply reel 38. The cassette may be formed of plastic, and may be of one piece construction with an integral hinge 112 joining the top and bottom sections.

Take-up reel 44 is preferably directly driven by a motor-gear drive means unit 58 which is mounted within central module 46, in turn mounted to the lower housing 26, along with the control electronics to be discussed infra. The motor-gear set is chosen to provide sufficient torque to wind the sleeve material 28 upon the take-up reel 44 when energized, thereby pulling the sleeve material along the length of the seat whereby a new length of the sleeve is dispensed onto the seat from the supply reel 38. The motor-gear set may preferably utilize a 115 r.p.m., 12 volt d.c. motor coupled to a gear train having an overall 65.5:1 ratio (motor:output) producing 175 ounce-inches of torque.

Because seat 16 is mounted to the lower housing 26 at its second end 20, means must be provided to allow the sleeve material to exit from the seat for take-up on reel 44. Accordingly, a knife 48 is provided and positioned such that, as the sleeve material is pulled by the take-up reel, it is slit along its length, allowing the sleeve to pass off connecting arm 24 and the fixed second end of the seat. The knife may be mounted to the forward end of seat connecting arm 24 in a horizontal position to slit the outer side of the sleeve as it passes the blade.

In order to provide appropriate control signals to the motor-gear set to allow a correct amount of sleeve to be dispensed onto the seat upon command, the sleeving 28 is provided with a plurality of registration marks at regular intervals along its length. As may be seen, such marks may preferably constitute a plurality of equally spaced transverse lines or hash marks 50, preferably located on the bottom surface of the sleeve as oriented upon the seat.

Figure 7:
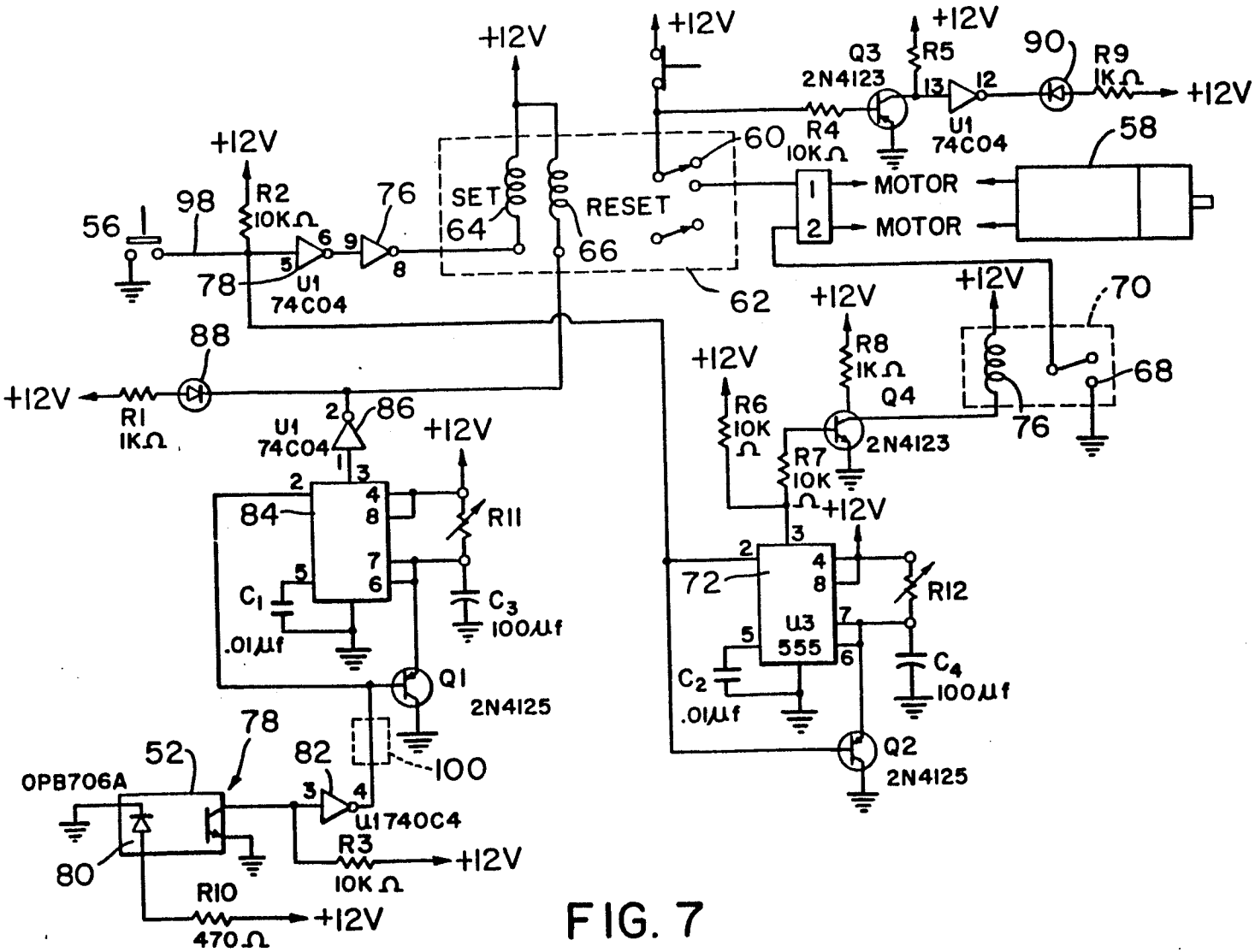
FIG. 7 is a schematic for the drive controller of the present invention.

A sensor 52, preferably located proximate the second end of the seat just forward of the knife 48 and mounted to the lower housing 26 upon pedestal 54, is positioned such that its active face points upwardly whereby the sensed zone intersects with the travel of the marks 50 as the sleeve material is taken up by take-up reel 38. The sensor may preferably be a opto-transistor, as known in the art, which includes an integral light source, typically infrared, and a mating radiation detector in the form of a semiconductor junction. The detector changes conductivity upon the sensing of radiation of the wavelengths emitted by the source, thus serving as a semi-conductor switch. The marks 50, typically of substantially opaque black ink, absorb a substantially greater amount of the emitted radiation than the unmarked portions of the sleeve, which are typically clear or of a light color, thus causing the semiconductor switch to toggle between conducting and non-conducting states as the line passes across the sensing zone of the sensor. The output of sensor 52 is coupled to control circuitry as shown in FIG. 7, whereby the operation of the motor-gear set 58 is controlled. The control circuitry is preferably located in the central module 46 adjacent the motor-gear unit. A transverse bar 114 is positioned on the lower surface of the seat second end 20, spaced past the sensor, which causes the lower surface of the sleeve bearing the marks to pass in close proximity to the sensor face, insuring accurate sensing.

With reference to FIG. 7, operation of the circuit is as follows:

Motor-gear unit 58 is connected to a direct current source, which may be provided by a 12 volt low-voltage power supply as known in the art, through contacts 60 of main relay 62. The power supply may be located at a remote location from the circuitry to isolate the toilet from line voltage and may be adapted to simultaneously power a plurality of seat systems. Relay 62 is of the set/reset type, which latches the contacts 60 in the closed position upon the application of power through the set coil 64, and releases the contacts upon activation of reset coil 66. A momentary current applied to either coil is sufficient to cause the associated relay operation. The second terminal of motor-gear set 58 connected to ground through the normally open contacts 68 of second relay 70, which is controlled by timer 72, as will be explained infra. It is to be appreciated that both relay 62 as well as relay 70 must be energized to permit power to be applied to the motor.

With the system in the standby mode, momentary activation of switch 56 grounds terminal 5 of the series pair of invertors, 74, 76, thus driving terminal 8 similarly to ground. This allows current flow through the set coil 64 of relay 62, applying current through normally closed circuit breaker 74 to the motor 58 through the relay contacts 60. At the same time, the trigger terminal 2 of timer 72 is driven low, activating the timer and causing the timer output at terminal 3 to go high for a predetermined period. With timer terminal 3 high, a current path to ground is created through resistors R7 and R8 and the base-emitter circuit of transistor Q4, turning the transistor on and permitting current to flow through coil 76 of relay 70. This closes the relay contacts 68 and completes the motor power circuit. With the motor energized sleeve material is wound onto the take-up reel, and a new length of sleeve is dispensed onto the seat.

As the sleeve material travels along the seat, sensor 52 monitors the reflected light returning to transistor junction 78 emitted by led portion 80. In the absence of a mark, the junction is a conducting state, keeping terminal 3 of invertor 82 low and thus its output at terminal 4 high. This maintains trigger terminal 2 of second timer 84 high and the timer disabled, whereby its output terminal 1 is high and thus the output terminal 2 of invertor 86 connected thereto is low. With invertor terminal 2 high, the bottom of reset coil 66 of main relay 62 is effectively at 12 volts, and thus the coil is disabled. The relay thus remains set, passing current to the motor 58.

When the passage of a mark is sensed by the sensor 52, the junction 78 steps conducting, raising terminal 3 of invertor 82 high. This places the timer trigger terminal 2 low, commencing a timing cycle as determined by the timer's associated components and raising timer output terminal 3 high. With its input now high, the output of invertor 86 at terminal 2 drops low, allowing current flow through the reset coil 64 of the main relay 62, whereby the contacts 60 open, causing motor 58 to stop. A new length of sleeve is thus positioned along the seat. At the same time led 88 is energized, providing a visual signal to the user that a new section of sleeve has been properly positioned on the seat.

Timers 72 and 84 are preferably integrated circuit timers of the 555 type, the length of the timing period of which is controlled by the time constant established by the resistor and capacitor combination affixed to terminals 6 and 7, as known in the art. The values of R11 and C3 associated with timer 84 are chosen to provide a timing period (output high) of about 20 seconds, which keeps the reset coil 66 of main relay 62 energized for the same period, commencing upon mark sensing. This disables the set function of the relay for that time period, and thus prevents renewed operation of the motor. This serves as a safeguard against repeated operation of switch 56 to dispense repeated lengths of sleeve without associated use thereof.

The combination of R12 and C4 associated with timer 72 are chosen to provide a timing interval (output high) of about 18 seconds. This interval is chosen to be somewhat longer than the time normally required by motor 58 to fully replace the length of sleeve along the seat. Normally, motor operation will be halted by the commencement of operation of timer 84 upon mark sensing by sensor 52. In the event of a loss of sleeve, for example, or another condition in which the sensor 52 fails to timely sense a mark, the timer 72 times out and releases relay 76, thus opening relay contacts 68 and shutting off the motor. Under normal conditions power is removed from the motor prior to timeout by reset of main relay 62, and relay 76 releases upon timeout of timer 72 without further effect on motor operation.

In the event of a motor overload, circuit breaker 74, which is in series with the motor control relays 62 and 70, opens, thus allowing current to flow through second led indicator 90, which serves as a visual indicator that the system is disabled and that maintenance is required.

Preferably, the two leds 88, 90 are mounted to the top portion of the center module 46, as seen in FIG. 1, and align with bores 94, 96 in the upper housing 92 such that the user can readily observe their status. The switch 56, which preferably may be of the momentary contact variety, may be remotely mounted, such as upon the wall behind the toilet, and is connected to the remainder of the control circuitry by extended leads 98. The upper housing may be affixed to the lower housing with appropriate fasteners, such as allen head bolts or other locking devices 102, which permit removal of the upper housing for maintenance purposes, including replacement of the supply reel 38 and removal of a full take-up reel 44, but frustrate unauthorized access.

It is to recognized that the timer 84 serves as a counter for the output pulses produced by sensor 52 as a mark is sensed thereby. As shown in the embodiment of FIG. 7, timer 84 is activated by each successive pulse. As the marks on the sleeve material are preferably spaced the length of the seat apart, each successive pulse corresponds to a complete reload cycle.

It is also possible, however, to utilize a sleeve in which the marks are spaced some fraction of the total length of the seat, such that a complete length of sleeve is placed on the seat and timer action occurs only after a predetermined plurality of marks have been sensed. For example, with marks spaced one quarter seat length apart, four marks must be sensed for a full reload cycle to occur. In order to allow such operation, a discrete counter circuit 100, shown in phantom in FIG. 7, may be employed in the output line for invertor 82. Such a counter may be in the form of a programmable divide by n integrated circuit, producing an output pulse upon accumulation of a predetermined number of input pulses. Such integrated circuits are known in the art, and allow the use of different mark patterns on the sleeving.

Such an embodiment may be of value, for example, when a given sleeve material is intended to be used upon seats or other armatures of different lengths. With appropriate choice of mark spacing and pulse counting, sleeve dispensation may be adjusted for differing armature lengths. It is to be recognized that the divider 100 may be configured as a divide by 1 counter, thus allowing the embodiment to be used even when the sleeve marks are positioned a seat length apart.

It is important to insure that when motor operation ceases at the end of a reload cycle, the last sensed mark clears the active sensing zone of the sensor. This insures that upon reactivation the output of the sensor properly reflects sleeve travel. Accordingly, the motor-gear set 58 is chosen to have a small amount of rotational inertia upon shutoff. This inertia continues to rotate the pick-up reel 44 slightly after shutoff, thus drawing an additional small length of sleeve off the supply reel 38 and allowing the last-sensed mark to clear the sensor. The sensor is then ready to sense the following mark upon reactivation of the drive. It has been found that a motor-gear set having the characteristics previously set forth can provide the appropriate inertia effects.

I claim:

1. Apparatus for dispensing predetermined lengths of a continuous tubular material about the length of an armature having first and second ends, comprising a tubular material source located proximate said first end and a tubular material collector located proximate said second end;

guide means mounted to said first end to direct said tubular material onto and about said armature at said first end;

drive means coupled to said collector to pull said tubular material along said armature from said source onto said collector;

means affixed to said tubular material at fixed intervals therealong to mark continuous lengths thereof;

sensor means located proximate said second end to generate a count signal upon the passage of each of said marking means thereby;

and control means operatively connected to said sensor and drive means to activate said drive means upon receipt of a start signal for a period of time associated with a predetermined number of said count signals being received from said sensor means, whereby a predetermined length of said tubular material passes from said source onto said armature, a corresponding length of tubular material previously upon said armature being collected by said collector.

2. The apparatus of claim 1, wherein said control means further comprise first timer means activated by said start signal to stop said drive means after the passage of a predetermined time in the absence of the receipt by said control means of said predetermined number of count signals from said sensor.

3. The apparatus of claim 2, wherein said control means further comprises second timer means to inhibit operation of said drive means for a fixed period after receipt of the predetermined number of count signals from said sensor.

4. The apparatus of claim 1, 2 or 3, wherein said marking means are spaced on said tubular material a distance slightly greater than the length of said armature and wherein said predetermined number of count signals from said sensor is one.

5. The apparatus of claim 4, wherein said marking means comprise a plurality of spaced longitudinal marks on a contrasting background.

6. The apparatus of claim 5, wherein said marking means are placed on a portion of said tubular material embracing a lower portion of said armature.

7. The apparatus of claim 5, wherein said sensor comprises a opti-transistor.

8. The apparatus of claim 5, wherein said drive means further comprise means to clear said marking means from a sensing zone of said sensor in conjunction with the stopping of said drive means.

9. The apparatus of claim 7, wherein said clearing means comprise a motor and gear train assembly having rotational inertia effects after motor shutoff.

10. Apparatus for supplying a cover on a toilet seat comprising:

a toilet seat in a generally ring-like configuration having first and second ends;

a cover supply and takeup assembly comprising a cover source comprising a continuous length of tubular cover material having a plurality of marks thereon dividing the length thereof into equal segments located proximate said first end for supplying fresh cover material to be arranged along the length of the seat and about its surface and a cover collector located proximate said second end for the take-up of used cover material from the seat;

drive means operatively connected to said cover supply and takeup assembly for dispensing fresh cover material onto said seat and used cover material into said collector;

sensor means for sensing the passage of each of said marks past a fixed point along said seat and generating a sensor signal in response thereto; and control means connected to said sensor and drive means for operating said drive means in response to a start signal for a period associated with a count of the signals generated by said sensor means to provide fresh cover material along the length of the seat.

11. The apparatus of claim 10, wherein said control means comprise means for operating said drive means until a predetermined number of said sensor signals are received.

12. The apparatus of claim 11, wherein said marks are located upon said cover material a length substantially equal to the length of said seat, said predetermined number of sensor signals being one.

13. The apparatus of claim 11, wherein said control means further comprise a first timer to halt operation of said drive means in the event said predetermined number of sensor signals are not received within a predetermined time period from said start signal.

14. The apparatus of claim 13, wherein said control means further comprise a second timer to inhibit operation of said drive means for a predetermined time interval from the receipt of the last of said predetermined number of sensor signals.

15. The apparatus of claim 13 further comprising manually-operated switch means for providing said start signal.

16. The apparatus of claim 15, wherein said switch means is a momentary-contact switch.

17. The apparatus of claim 11 further comprising means located at the first end of said seat for guiding said cover material onto said seat.

18. The apparatus of claim 17 wherein said guide means comprise a horn projecting from said first end towards said cover source at an angle thereto, a portion of said first end adjacent said horn being of decreased width from that of a majority of said seat.

* * * * *